US005158281A

United States Patent [19]

Williams

[11] Patent Number: 5,158,281

[45] Date of Patent: Oct. 27, 1992

[54] PORTABLE BASKETBALL GOAL ASSEMBLY

[76] Inventor: Linkwood Williams, 1179 E. Parkway S., Memphis, Tenn. 38114

[21] Appl. No.: 800,132

[22] Filed: Nov. 29, 1991

[51] Int. Cl.[5] ..... A63B 63/08

[52] U.S. Cl. ..... 273/1.5 R; 248/910

[58] Field of Search ..... 273/1.5 R; 248/910

[56] References Cited

U.S. PATENT DOCUMENTS

| | | | |
|---|---|---|---|
| 2,194,779 | 3/1940 | Albach | 273/1.5 R |
| 3,017,183 | 1/1962 | Chalcroft | 273/1.5 R |
| 3,025,058 | 3/1962 | Brumfield | 273/1.5 R |
| 3,341,197 | 9/1967 | Bottorff | 273/1.5 R |
| 3,427,025 | 2/1969 | Proctor | 273/1.5 R |
| 3,841,631 | 10/1974 | Dolan | 273/1.5 R |
| 4,591,126 | 5/1986 | Berney | 248/910 X |
| 4,613,136 | 9/1986 | Raba et al. | 248/910 X |
| 4,759,545 | 7/1988 | Grable | 273/1.5 R |

FOREIGN PATENT DOCUMENTS

| | | | |
|---|---|---|---|
| 391977 | 9/1965 | Switzerland | 249/910 |

*Primary Examiner*—Paul E. Shapiro
*Attorney, Agent, or Firm*—Richard C. Litman

[57] ABSTRACT

A portable basketball goal assembly which includes an anchor, a goal post, a backboard, and a basket. The mass of the anchor is variable to promote mobility. The anchor includes a nonpermeable receptacle which facilitates the storage of a volume of substance, such as water. The container may be either a drum, such as an industrial drum, a rain barrel, a garbage canister, or the like, or it may be an industrial strength bag suspended from a frame assembly both of which are capable of retaining the volume of substance. The volume of substance is proportional to the mass of the anchor. A variance in the volume of substance produces a variance in the mass of the anchor. The nonpermeable receptacle has an opening in the top to allow the user to add to the volume of substance, thus increasing the mass of the anchor. Also included near the bottom of the nonpermeable receptacle is a stopclock which enables the user to discharge some of the volume thereby decreasing the mass of the anchor. The goal post is supported by the anchor which supports the backboard which, in turn, supports the basket. The variable mass of the anchor permits the anchor to provide adequate support for the goal post as well as enhances the portability of the basketball goal assembly.

15 Claims, 2 Drawing Sheets

PORTABLE BASKETBALL GOAL ASSEMBLY

BACKGROUND OF THE INVENTION

1. Field of the Invention

The present invention relates to a portable basketball goal assembly having a variable mass.

2. Description of Prior Art

It is not uncommon to find a basketball goal mounted on a house, on a garage front, or on a goal post anchored in the ground adjacent the edge of a driveway. However, mounting a basketball goal in this manner is usually desired only if the mounting is intended to be permanent. Often, the removal of the backboard from the house or a garage front leaves the garage defaced which depreciates the value of the home, one of the single largest investments an individual will ever make. Removing a goal post from the ground, if installed Properly, will undoubtedly require the goal post to be dug up along with the concrete it was anchored in. Then comes the onerous task of removing the concrete from the goal post, breaking up and disposing of the concrete, and filling the hole left behind. A portable basketball goal provides an alternative to this permanent type of installation. The user is not required to perform the arduous task of hanging the goal assembly on the house, no more ground breaking and concrete pouring. It is ideal for persons living in rental properties. A portable basketball goal is easily disassembled and stored or moved to a new location without leaving unsightly. A portable basketball goal assembly includes four major components, a portable anchor, a goal post, a backboard, and a basket. The anchor supports the goal post and the backboard and basket subassembly. An anchor must be substantially heavy in order to Provide adequate support. But, the heavier the anchor, the less portable the basketball goal assembly becomes. A basketball goal assembly which incorporates an anchor having a variable mass provides sufficient support as well as optimum portability.

There are portable basketball goal assemblies. However, no portable basketball goal assemblies provide a portable anchor having a variable mass.

U.S. Pat. No. 2,194,779 issued Mar. 26, 1940 to Frank Aibach disclosed a game-goal including a base, a standard, and a basket.

U.S. Pat. No. 3,017,183 issued Jan. 16, 1962 to Charles P. Chalcroft reveals a portable goal assembly comprising a base, a first and second standard radially linked and telescopically extendible.

U.S. Pat. No. 3,025,058 issued Mar. 13, 1962 to Robert N. Brumfield divulges a portable and adjustable basketball goal having a weighted base, a telescopic vertical upright extending from the rear of the base, and a set of wheels to provide mobility.

U.S. Pat. No. 3,341,197 issued Sept. 12, 1967 to Richard D. Bottorff displays a portable adjustable game apparatus and more particular, a portable support for a basketball mast.

None of the above patents, taken either singly or in combination, is seen to describe the instant invention as claimed.

SUMMARY OF THE INVENTION

The present invention relates to a portable basketball goal assembly. The portable basketball goal assembly includes an anchor, a goal post, a backboard, and a basket. The anchor supports the goal post which provides support for the backboard which has the basket secured thereon. A portable basketball goal assembly requires the anchor to have a mass which is substantial enough to provide adequate support for the goal post, backboard, and basket yet have a mass meager enough to provide effortless mobility. The present invention includes an anchor having a variable mass. The anchor encompasses a nonpermeable receptacle which permits the storage of a volume of substance. The volume of substance is proportional to the mass; therefore, a variance in the volume creates a change in the mass. The nonpermeable receptacle has an opening to enable the user to add substance to the nonpermeable receptacle which increases the mass of the anchor. The volume can be increased until the desired mass is reached or until the nonpermeable receptacle is full. Also, a valve is located near the bottom of the nonpermeable receptacle. This enables the user to discharge all or a portion of the substance contained within the nonpermeable receptacle, thus decreasing the volume and the mass of the anchor. This provides an anchor with a mass suitable to support the goal post, backboard, and basket and moreover, an anchor which can be readily moved simply by varying the mass.

Accordingly, one object of the present invention is to provide a portable basketball goal assembly including an impermanent anchor having a variable mass efficacious to support the goal post and backboard subassembly, yet grants satisfactory mobility.

Another object of the present invention is to provide a basketball goal assembly which includes a vertically adjustable goal post.

Another object of the present invention is to provide a basketball goal assembly which is readily assembled and disassembled, which is compact in size when disassembled, and is easily stored when not in use.

A further object of the present invention is to provide a basketball goal assembly which is easy to manufacture.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
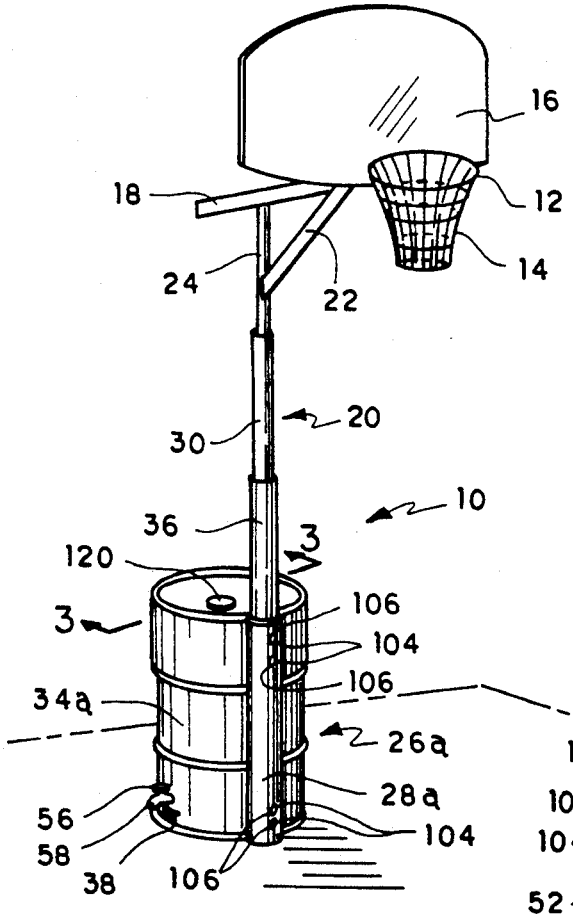
FIG. 1 is a front perspective view of the present invention according to a preferred embodiment.
Figure 2:
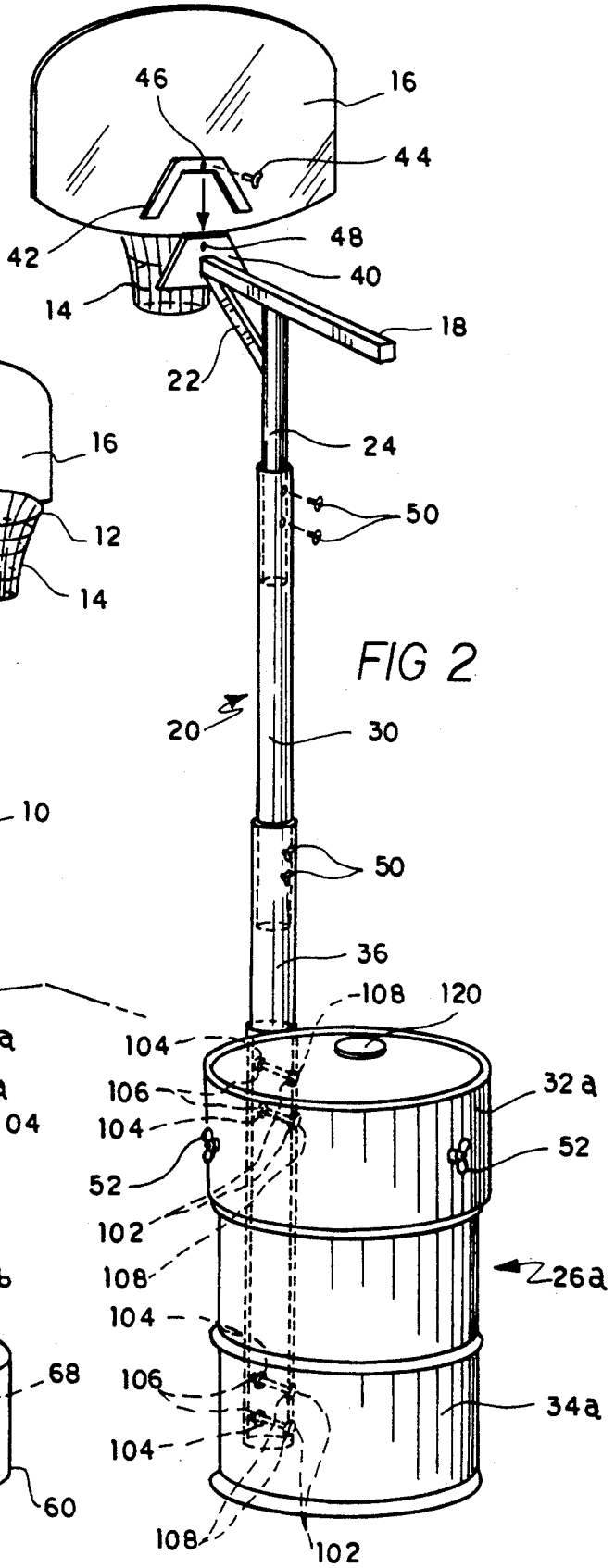
FIG. 2 is a rear perspective of the present invention according to the preferred embodiment.

Now referring to the drawings, FIGS. 1-2 show the basketball goal assembly 10 according to the present invention. The basketball goal assembly 10 includes a hoop 12, a backboard 16, a standard 20, and an anchor 26*a*. The hoop 12 having a net 14 suspended thereon is perpendicularly secured to a horizontally central lower portion of the backboard 16. A grooved flange 42, having a half hexagonal shaped parameter, is integrally attached to a horizontally central lower rear portion of the backboard 16. The top of the grooved flange 42 includes a horizontally centered bore 46 to permit the insertion of a threaded shaft 44. A plate 40 is affixed perpendicularly to a forward end of a horizontal extension 18. A uppermost portion of the plate 40 is tapered n and a threaded bore 48 is horizontally centered adjacent the top edge of the plate 40. The backboard 16 is fastened to a front most portion of a horizontal extension 18 by slipping the plate 40 into the grooved flange 42. The backboard 16 is held vertically in check by the tapered joint configuration of the plate 40 and the grooved flange 42. Moreover, the backboard 16 is bound in the vertical as well as the horizontal position by inserting the threaded shaft 44 into the bore 46 located on the grooved flange 42 and tightening the threaded shaft 44 into the threaded bore 48 in the plate 40. The longitudinal center of the horizontal extension 18 is connected to the top end of the standard 20 to form a right angle between the horizontal extension 18 and the standard 20. A crossbar 22 is fixed to the horizontal extension 18 contiguous to the plate 40 reaching downward diagonally a vertical distance equal to the horizontal distance from the longitudinal center of the horizontal extension 18 to the plate 40 engaging with the top telescopic section 24 of said standard 20.

The standard 20 includes a plurality of cascading tubular telescopic sections 24,30,36. The top telescopic section 24 has an outside diameter which has a loose fit configuration with the inside diameter of the center telescopic section 30; the center telescopic section 30 has an outside diameter which has a loose fit configuration with the inside diameter of the bottom telescopic section 36. The bottom portion of the top telescopic section 24 fits inside of the top portion of the center telescopic section 30 and the bottom portion of the center telescopic section 30, in turn, fits inside the top portion of the bottom telescopic section 36. The bottom portion of the bottom telescopic section 36 is inserted into a sleeve 28*a* and both the bottom telescopic section 36 and the sleeve 28*a* are vertically fastened to the front of the anchor 26*a*. The top and center telescopic sections 24,30 can be adjusted in succession to provide a standard 20 of a desired height and are secured to maintain the desired height by tightening the set screws 50.

Figure 8:
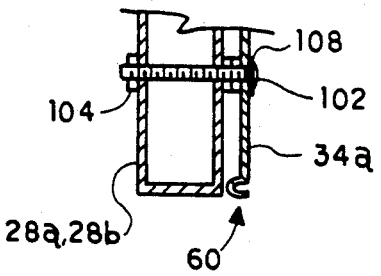
FIG. 8 is a cross-section view showing the connection of the sleeve to the lower portion of the container.

The anchor 26*a* of the preferred embodiment is a nonpermeable receptacle including a cylindrical container 34*a* and a mating cylindrical lid 32*a*. The container 34*a* can be an industrial drum, a rain barrel, a garbage can or any other waterproof vessel. The peripheral side wall of the lid 32*a* has an inside surface which has a loose fit configuration with the outside surface of the upper portion of the container 34*a*. The lid 32*a* is placed on the container 34*a* and secured into place with threaded shafts 52 having wing shaped heads. The sleeve 28*a* and the telescopic section 36 are fastened to the lid 32*a* to provide a sturdy and durable bond. Carriage bolts 102 are inserted through the lid 32*a*, the sleeve 28*a*, and the bottom telescopic section 36 to provide a substantially flush fit on the inside surface of the lid 32*a*. The carriage bolts 102 are then secured in place by applying a nut 104 and a washer 106 to the carriage bolt 102 until tight. To provide additional vertical stability, the lower portion of the sleeve 28*a* is also secured to the lower portion of the container 34*a* in the same manner, however, a gasket 108 is used to provide a leakproof seal. The sleeve 28*a* must be secured to the lid 32*a* prior to putting the lid 32*a* on the container 34*a* and the carriage bolts 102 adjacent the lower portion of the container 34*a* must be fixed to the container 34*a* prior to attaching the lid 32*a* and the sleeve 28*a* to the container 34*a*. These carriage bolts 102 adjacent the lower portion of the container 34*a* are inserted through holes 110 in the container 34*a* using gaskets 108 against the inside surface of the container 34*a* between the container 34*a* and the carriage bolts 102 to provide a leakproof seal. Washers 106 and a nuts 104 are applied to the portion of the carriage bolts 102 extending through the outside surface of the container 34*a* and are tightened to secure the carriage bolts 102 into a stationary position (see FIG. 8). After the carriage bolts 102 are set in place, the lid 32*a* is attached and the sleeve 28*a* combined are secured by applying a nut 104.

Figure 7:
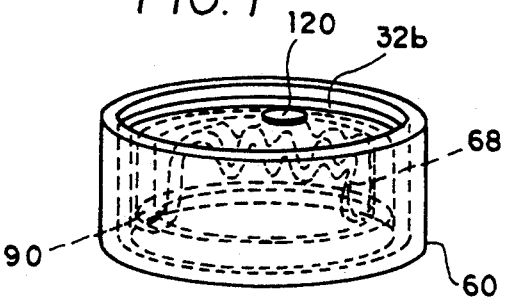
FIG. 7 is a perspective view of the present invention showing the container of the alternative embodiment in a collapsed form.
Figure 4:
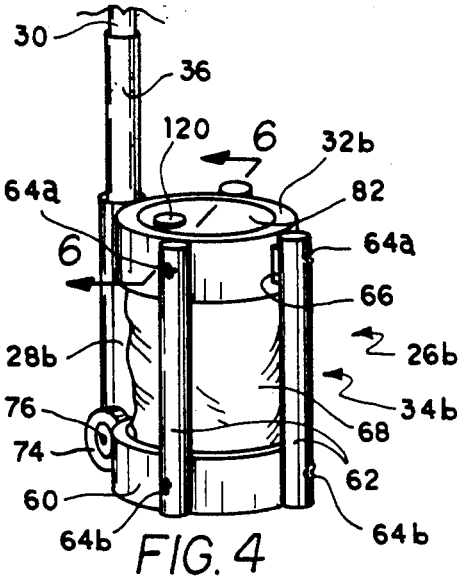
FIG. 4 is a side perspective view of the present invention showing the anchor of an alternative embodiment.
Figure 6:
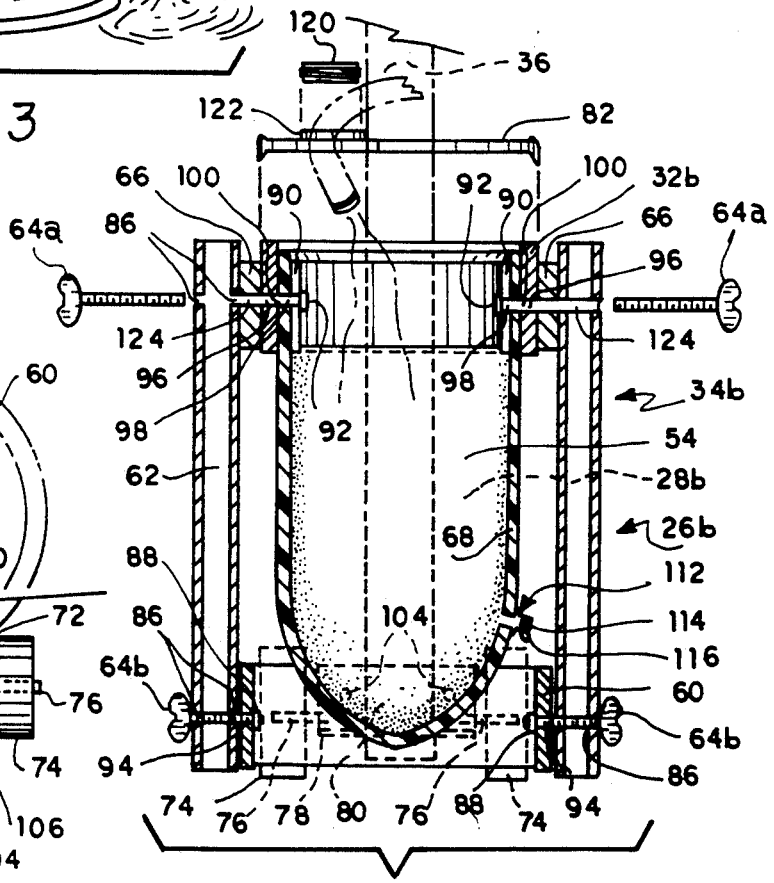
FIG. 6 is a side elevational cross-sectional view of the alternative embodiment of the present invention taken along the line 6—6 in FIG. 4 illustrating the anchor containing a volume of substance.

FIGS. 4 and 6 illustrate the anchor 26*b* according to a first alternative embodiment which includes a cylindrical container 34*b* comprised of a cylindrical lid 32*b*, a cylindrical base 60, three vertical tubular members 62, and the sleeve 28*b*. The lid 32*b* and the base 60 are joined by the three tubular members 62 and the sleeve 28*b* spaced equidistantly apart about the circumference of the lid 32*b* and the base 60. The bottom of each of the tubular members 62 and the sleeve 28*b* are secured to the base 60. This is accomplished by aligning a bore 86 in the bottom end of one of each of the tubular members 62 and the sleeve 28*b* with a bore 94 in the base 60, each bore 94 in the base 60 leading to a threaded boss 88 on the interior of the base 60. A threaded shaft 64*b*, having a winged head, is inserted into each one of the bores 86 in the bottom of each one of the tubular members 62 and the sleeve 28*b*, and further through each of the bores 94 in the base 60. Each threaded shaft 64*b* is tightened into a respective threaded boss 88 until the three tubular members 62 and the sleeve 28*b* are vertically stationary. The top of the tubular members 62 and the sleeve 28*b* are fastened to the lid 32*b* in a similar manner in which the bottom of the tubular members 62 are fastened to the base 60 with the exception that an industrial strength nonpermeable bag 68 is clamped and suspended from the lid 32*b* and spacers 66 are required to compensate for a difference in the diameter of the lid 32*b* and the diameter of the base 60. The lid 32*b* is smaller in diameter than the base 60 to permit the lid 32*b* to fit in the base 60 along with the ring clamp 90 and the bag 68 when the basketball goal assembly 10 is being stored (see FIG. 7). The bores 86 in the top of each of the tubular members 62 and in the top of the sleeve 28*b* are each aligned with the bores 124 in a spacer 66, with one of each of the bores 96 in the lid 32*b*, and further with one of each of the bores 98 in a ring clamp 90, each of the bores 98 in the ring clamp 90 leading to a threaded boss 92 adjacent the inside surface of the ring clamp 90. The spacers 66 are sandwiched between the tubular members 62 and the lid 32*b* and between the sleeve 28*b* and the lid 32*b*. The bag 68 is sandwiched between the inside surface of the lid 32*b* and the outside surface of the ring clamp 90 and is provided with holes 100 which align with the bores 86,124,96,98 to permit the passage of the threaded shafts 64*a* passing through the bores 86,124,96,98. With the bores 86,124,96,98 and the holes 100 in the bag 68 aligned, the threaded shafts 64*a* are inserted through the bores 86,124,96,98 and through the holes 100 in the bag 68 and are tightened into the threaded bosses 92. The threaded shafts 64*a* are tightened to sandwich the bag 68 between the inside surface of the lid 32*b* and the ring clamp 90 firm enough to hold the bag 68 and a volume of substance 54 in suspension. When assembling or disassembling the container 34*b*, the bag 68 and the ring clamp 90 may be manipulated from below lid 32*b* but as an alternative, the top 82 of the lid 32*b* can be removable to provide easier assembly and disassembly of the container 34*b*.

Figure 3:
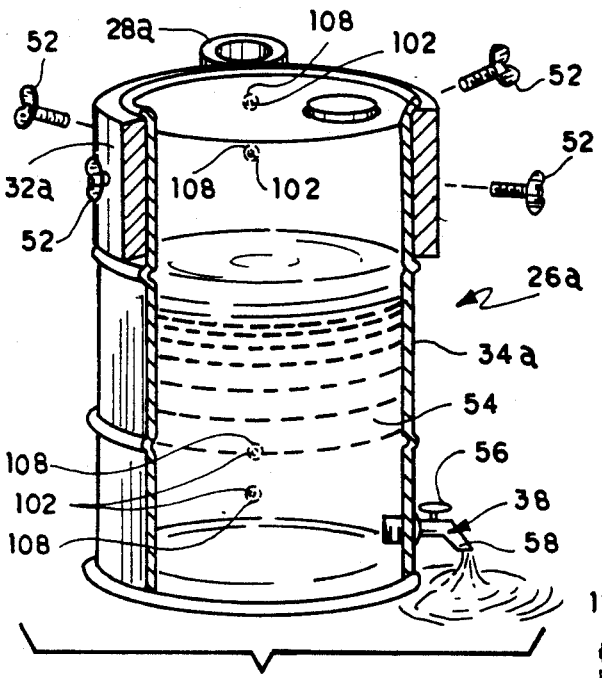
FIG. 3 is a partially exploded cross-sectional view of the preferred embodiment of the present invention taken along the line 3—3 in FIG. 1 showing the anchor.

As shown in FIG. 3 and FIG. 6, the lids 32*b* has a top 82 which includes an opening 122 which is accessed by removing a cap 120. The opening 122 enables the user to fill the anchors 26*a*,26*b* with a volume of liquid substance 54, such as water. The volume of liquid substance 54 is proportional to the mass of the anchors 26*a*,26*b*. Hence, by adding to the volume of liquid substance 54, the mass is increased. The container 34*a* according to the preferred embodiment has a bottom surface and a stopcock 38 bordering thereon. The stopcock 38 encompasses a handle 56 and a nozzle 58. The user is permitted to discharge any portion of the volume of liquid substance 54 by opening the handle 56 and releasing any portion of the volume of liquid substance 54 through the nozzle 58, thus decreasing the volume of liquid substance 54 and in turn decreasing the mass of the anchor 26*a*. The container 34*b* incorporates the bag 68 which has a bottom surface with a relief valve 112 located thereon. The relief valve 112 includes a plug 114, which when removed from a mating nipple 116 permits the discharge of any portion of the volume of liquid substance 54 through the nipple 116, thus decreasing the volume of liquid substance 54 and again, decreasing the mass of the anchor 26*b*.

Figure 5:
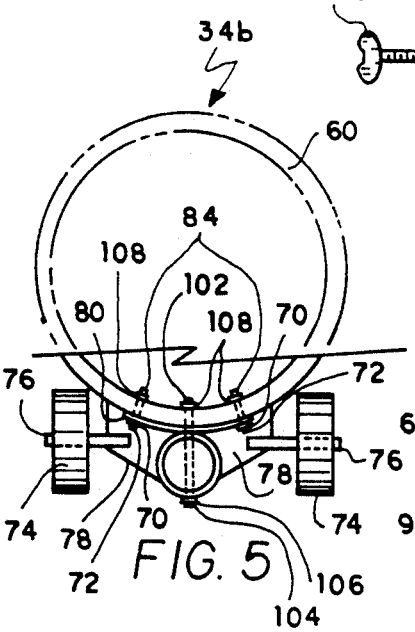
FIG. 5 is a top plan view showing the anchor of the preferred embodiment of the present invention with the mobile support subassembly attached.

As shown in FIG. 4, FIG. 5, and FIG. 6, a mobile support subassembly 78 can be adapted to be used with either the anchor 26*a* according to preferred embodiment or the anchor 26*b* according to the alternative embodiment. The mobile support subassembly 78 is welded to the sleeve 28*b* and includes a back plate 80 which conforms to the outside of the peripheral wall of the base 60. The back plate 80 is secured to the container 34*b* to provide a leakproof seal by inserting two threaded shafts 84 through a gasket 108 then through the base 60; the two threaded shafts 84 are inserted through the back plate 80; a washer 70 is applied to each of the threaded shafts 84; and a mating threaded nut 72 is threaded onto each of the threaded shafts 84 and is tightened to hold the back plate 80 firmly against the base 60. The mobile support subassembly 78 includes two wheels 74 axially aligned, one wheel 74 on each side of the sleeve 28*b* and each wheel 74 equally space from the sleeve 28*b*. Each wheel 74 is rotatably attached to one end of an axle 76 having an opposite end welded to the mobile support subassembly 78. With regard to anchor 26*a*, the backplate 80 may be attached to sleeve 26*a* and attached directly to the container 34*a* in a similar fashion.

It is to be understood that the present invention is not limited to the embodiments described above, but encompasses any and all embodiments within the scope of the following claims.

I claim:

1. A portable basketball goal assembly comprising:

an anchor means having a variable mass and including a nonpermeable receptacle to facilitate the storage of a volume of substance, said nonpermeable receptacle comprising a lid, a base, a flexible reservoir, means to attach said lid to said base, an means to suspend said flexible reservoir from said lid, said anchor means further having a means to vary said variable mass, whereby said variable mass is proportional to a variance in said volume of substance stored in said nonpermeable receptacle;

a standard releasably connected to said anchor means;

a backboard secured to said standard; and a basket fastened to said backboard.

2. The portable basketball goal assembly according to claim 1, wherein said volume of substance includes a volume of liquid.

3. The portable basketball goal assembly according to claim 2, wherein said volume of liquid includes a volume of water.

4. The portable basketball goal assembly according to claim 1, wherein said means to vary said variable mass includes an access means and a stopcock whereby said volume of substance is added to said anchor means through said access means thereby providing a means to increase said variable mass and said volume of substance is discharged from said anchor means through said stopcock thereby providing a means to decrease said variable mass.

5. The portable basketball goal assembly according to claim 1, wherein said anchor means includes mobile support means to provide mobility for said anchor means.

6. The portable basketball goal assembly according to claim 5, wherein said mobile means are attached to a lower forward portion of said anchor means.

7. The portable basketball goal assembly according to claim 5, wherein said mobile support means includes a wheel rotatably affixed to a lower forward portion of said anchor means.

8. The portable basketball goal assembly according to claim 5, wherein said mobile support means includes a plurality of wheels axially aligned and rotatably mounted on opposite sides of a lower forward portion of said anchor means.

9. The portable basketball goal assembly according to claim 1, wherein said standard intersects and passes through a forward portion of said anchor means.

10. The portable basketball goal assembly according to claim 1, wherein said standard is comprised of a plurality of telescopic sections whereby said standard has an adjustable length provided by said plurality of telescopic sections.

11. The portable basketball goal assembly according to claim 1, wherein said standard includes an extension attached substantially perpendicular to an uppermost end of an uppermost telescopic section, said extension has said backboard secured thereon.

12. The portable basketball goal assembly according to claim 11, wherein a lower rear portion of said backboard is centrally attached substantially perpendicular to said extension extending said backboard a predetermined distance forward of said anchor means in a plane substantially parallel to said standard.

13. The portable basketball goal assembly according to claim 11, wherein said extension extends a predetermined distance forward of said anchor means.

14. A portable basketball goal assembly comprising:

an anchor means including a nonpermeable receptacle, a variable mass and a means to vary said variable mass, said nonpermeable receptacle comprises a lid, a base, a means to attach said lid to said base, a flexible reservoir, and a means to suspend said flexible reservoir from said lid, said means to vary said variable mass comprises an access means and a stopcock, whereby said nonpermeable receptacle facilitates a storage of a volume of liquid, said liquid is added to said receptacle through said access means providing a means to increase said variable mass and said liquid is discharged through said stopcock providing a means to decrease said variable mass;

a standard, including a plurality of telescopic sections, and an extension attached substantially perpendicular to an uppermost end said standard such that said extension extends a predetermined distance forward of said anchor means, said standard releasably attaches to a forward portion of said anchor means by intersecting and passing through a forward portion of said anchor means, said plurality of telescopic sections provide a means to adjust said adjustable length;

a backboard having a lower rear portion centrally secured substantially perpendicular to a forward end of said extension thereby extending said backboard a predetermined distance forward of said anchor means in a plane substantially parallel to said standard; and a basket fastened centrally and substantially perpendicularly to a lower front portion of said backboard.

15. The portable basketball goal assembly according to claim 14, wherein said anchor means includes mobile support means including a wheel rotatably affixed to a lower forward portion of said anchor means providing mobility for said anchor means.

* * * * *